US007422162B2

(12) United States Patent
Wang et al.

(10) Patent No.: US 7,422,162 B2
(45) Date of Patent: Sep. 9, 2008

(54) AUTOMATIC WATER INLET SWITCHING DEVICE FOR AN OSCILLATING SPRINKLER

(75) Inventors: King Yuan Wang, Changhua Hsien (TW); Shun Nan Lo, Changhua Hsien (TW)

(73) Assignee: Yuan Mei Corp., Changhua Hsien (TW)

( * ) Notice: Subject to any disclaimer, the term of this patent is extended or adjusted under 35 U.S.C. 154(b) by 182 days.

(21) Appl. No.: 11/349,156

(22) Filed: Feb. 8, 2006

(65) Prior Publication Data

US 2007/0119978 A1 May 31, 2007

(30) Foreign Application Priority Data

Nov. 30, 2005 (TW) ..... 94142084 A

(51) Int. Cl.
*B05B 3/16* (2006.01)

(52) U.S. Cl. ..... 239/242; 239/262.3; 239/262.4; 239/244

(58) Field of Classification Search ..... 239/240, 239/242, 262.2, 262.3, 262.4
See application file for complete search history.

(56) References Cited

U.S. PATENT DOCUMENTS

| | | | | | |
|---|---|---|---|---|---|
| 3,034,728 | A | * | 5/1962 | Hruby, Jr. | 239/206 |
| 3,977,610 | A | | 8/1976 | Royer | 239/230 |
| 4,069,976 | A | * | 1/1978 | Chauvigne | 239/242 |
| 4,140,278 | A | | 2/1979 | Troup | 239/242 |
| 4,166,578 | A | | 9/1979 | Skwara | 239/242 |
| 4,220,284 | A | | 9/1980 | Beiswenger et al. | 239/242 |
| 4,221,333 | A | | 9/1980 | Rodriguez | 239/255 |
| 4,501,391 | A | * | 2/1985 | Hunter | 239/97 |
| 4,545,532 | A | | 10/1985 | Schanz et al. | 239/242 |
| 4,568,023 | A | | 2/1986 | Hayes | 239/242 |
| 4,568,024 | A | | 2/1986 | Hunter | 239/242 |
| 4,606,500 | A | | 8/1986 | Mussler et al. | 239/242 |
| 4,708,291 | A | | 11/1987 | Grundy | 239/242 |
| 4,718,605 | A | | 1/1988 | Hunter | 239/242 |
| 4,721,248 | A | | 1/1988 | Chow | 239/242 |
| 4,860,954 | A | * | 8/1989 | Allemann | 239/101 |
| 4,877,185 | A | | 10/1989 | Kufrin | 239/242 |

(Continued)

FOREIGN PATENT DOCUMENTS

CA 2266247 9/2000

(Continued)

*Primary Examiner*—Trevor E. McGraw
(74) *Attorney, Agent, or Firm*—Troxell Law Office, PLLC

(57) ABSTRACT

The present invention relates to an automatic water inlet switching device for an oscillating sprinkler that has a sprinkle control unit having a blade equipped gear transmission set housed therein, working together with a water inlet switching device having an operation unit and a movable swinging seat. The bottom of the movable swinging seat is provided with two water stop ends in opposite to two outlet holes defined on a coupling unit with a concaved bounded space placed at the center thereof. An action stick of the operation unit is operable inside the bounded space so that in the water inlet switching operation the swinging angle of the action stick is limited within the bounded space and the action stick will move against the push end thereof so as to produce a built-up force to instantaneously spring away the movable swinging seat no matter what the water pressure is high or low in operation.

10 Claims, 14 Drawing Sheets

U.S. PATENT DOCUMENTS

| | | | | | |
|---|---|---|---|---|---|
| 4,895,305 | A | | 1/1990 | Powell | 239/239 |
| 4,948,052 | A | | 8/1990 | Hunter | 239/242 |
| 4,955,542 | A | | 9/1990 | Kah, Jr. | 239/242 |
| 4,972,993 | A | | 11/1990 | Van Leeuwen | 239/206 |
| 5,033,678 | A | | 7/1991 | Borghese et al. | 239/242 |
| 5,042,719 | A | | 8/1991 | Magris et al. | 239/242 |
| 5,098,020 | A | | 3/1992 | Cooper et al. | 239/230 |
| 5,148,991 | A | * | 9/1992 | Kah, Jr. | 239/242 |
| 5,305,956 | A | * | 4/1994 | Wang | 239/242 |
| 5,511,727 | A | | 4/1996 | Heren et al. | 239/242 |
| 5,628,458 | A | * | 5/1997 | Kuo | 239/242 |
| 5,653,390 | A | | 8/1997 | Kah, Jr. | 239/242 |
| 5,673,717 | A | * | 10/1997 | Jinback | 134/167 R |
| 5,676,315 | A | * | 10/1997 | Han | 239/590 |
| 5,704,549 | A | | 1/1998 | Kephart et al. | 239/236 |
| 5,730,366 | A | | 3/1998 | DeWitt | 239/242 |
| 5,758,827 | A | * | 6/1998 | Van Le et al. | 239/242 |
| 5,845,850 | A | | 12/1998 | Guo | 239/242 |
| 5,868,318 | A | | 2/1999 | Roman | 239/242 |
| 6,109,545 | A | | 8/2000 | Kah, Jr. | 239/242 |
| 6,334,577 | B1 | | 1/2002 | Chih | 239/242 |
| 6,336,597 | B1 | | 1/2002 | Kah, Jr. | 239/242 |
| 6,732,952 | B2 | | 5/2004 | Kah, Jr. | 239/225.1 |
| 6,817,543 | B2 | | 11/2004 | Clark | 239/205 |
| 6,869,026 | B2 | * | 3/2005 | McKenzie et al. | 239/237 |
| 6,945,471 | B2 | * | 9/2005 | McKenzie et al. | 239/237 |
| 7,086,609 | B2 | * | 8/2006 | Wang | 239/263.3 |

FOREIGN PATENT DOCUMENTS

| | | | |
|---|---|---|---|
| DE | 1965958 | A2 | 3/1969 |
| DE | 3942086 | A1 | 12/1989 |
| EP | 0363717 | B1 | 4/1990 |
| EP | 0148905 | B1 | 9/1990 |
| EP | 0392712 | A2 | 10/1990 |
| EP | 0394653 | B1 | 8/1993 |
| EP | 0572746 | A1 | 12/1993 |
| EP | 0826427 | A2 | 3/1998 |
| EP | 0798047 | B1 | 8/2002 |
| FR | 2684568 | A1 | 6/1993 |
| GB | 1149287 | | 4/1969 |
| GB | 1176978 | | 1/1970 |
| GB | 2322572 | A | 9/1998 |
| WO | 85/00304 | | 1/1985 |
| WO | 2005/020663 | A1 | 3/2005 |

* cited by examiner

AUTOMATIC WATER INLET SWITCHING DEVICE FOR AN OSCILLATING SPRINKLER

BACKGROUND OF THE INVENTION

The present invention relates to an automatic water inlet switching device for an oscillating sprinkler. An actuation stick of the operation unit is operable inside a bounded space so that in the water inlet switching operation the bending angle of the actuation stick is limited within the bounded space and the actuation stick will move against one of the push faces thereof so as to produce a built-up force to instantaneously spring away the movable swinging seat to pivot to one side no matter what the water pressure is high or low in operation.

In general, the common water sprinkler for garden use is equipped with a switching device for varying the direction of water flow as shown in FIG. 1 of a European patent EP0826427A2. It has a coupling unit 10 provided with a couple of water outlet ports 11 that are controllably engaged with a control unit 14 which is controlled by a spring 12 and a control stick 13 so as to make the sprinkler operated by way of the water pressure. In operation, when the control stick 13 is driven by an operation device to swing to and come into contact with one side of the stop groove of a restraint unit, the control stick 13 will be forcedly biased to the other direction, and the spring 12 under the influence of the biased control stick 13 will drive the flat board of the control unit 14 to switch to the other side to cover up the other water outlet 11 to change the direction of the flow. So, the control stick 13 must be exerted by a force with a torsion force gradually built up on the spring 12 to make the control unit 14 switched smoothly. However, if the spring 12 is not limited by a bounded space, the torsion produced by the spring 12 can not be concentrated and be dispersed easily, resulting in the torsion of the spring 12 less than the suction force at the sealed end of the control unit 14 when the water pressure is high. This will cause the outlet port 11 unable to be sealed, and the spring 12 will remain so deformed in bending in abutment against the control unit 14 for a long period of time as well. The spring 12 will suffer from fatigue as a result of that reason, making the operation life thereof shortened.

SUMMARY OF THE INVENTION

Therefore, the primary object of the present invention is to provide an automatic water inlet switching device for an oscillating sprinkler wherein the water inlet switching device limits the actuation stick of an operation unit to move in a bounded space and relatively form a biased angle within that bounded space of a movable swinging seat so that the bending energy of the actuation stick can be concentrated to produce an instantaneous force on one of the push faces of the bounded space, allowing to effectively drive the movable swinging seat switched to another position for changing the direction of inflow water regardless of the level of water pressure in operation.

The second object of the present invention is to provide an automatic water inlet switching device for an oscillating sprinkler. In particular, after the movable swinging seat is pivoted to another position, the bent actuation stick in abutment against one of the push faces in the bounded space of the movable swinging seat can surely provide a maximum force against the movable swinging seat so that one of the water outlet ports can be effectively sealed and the other outlet ports wide open to make the operation in the best mode.

DETAILED DESCRIPTION OF THE PREFERRED EMBODIMENTS

Figure 1:
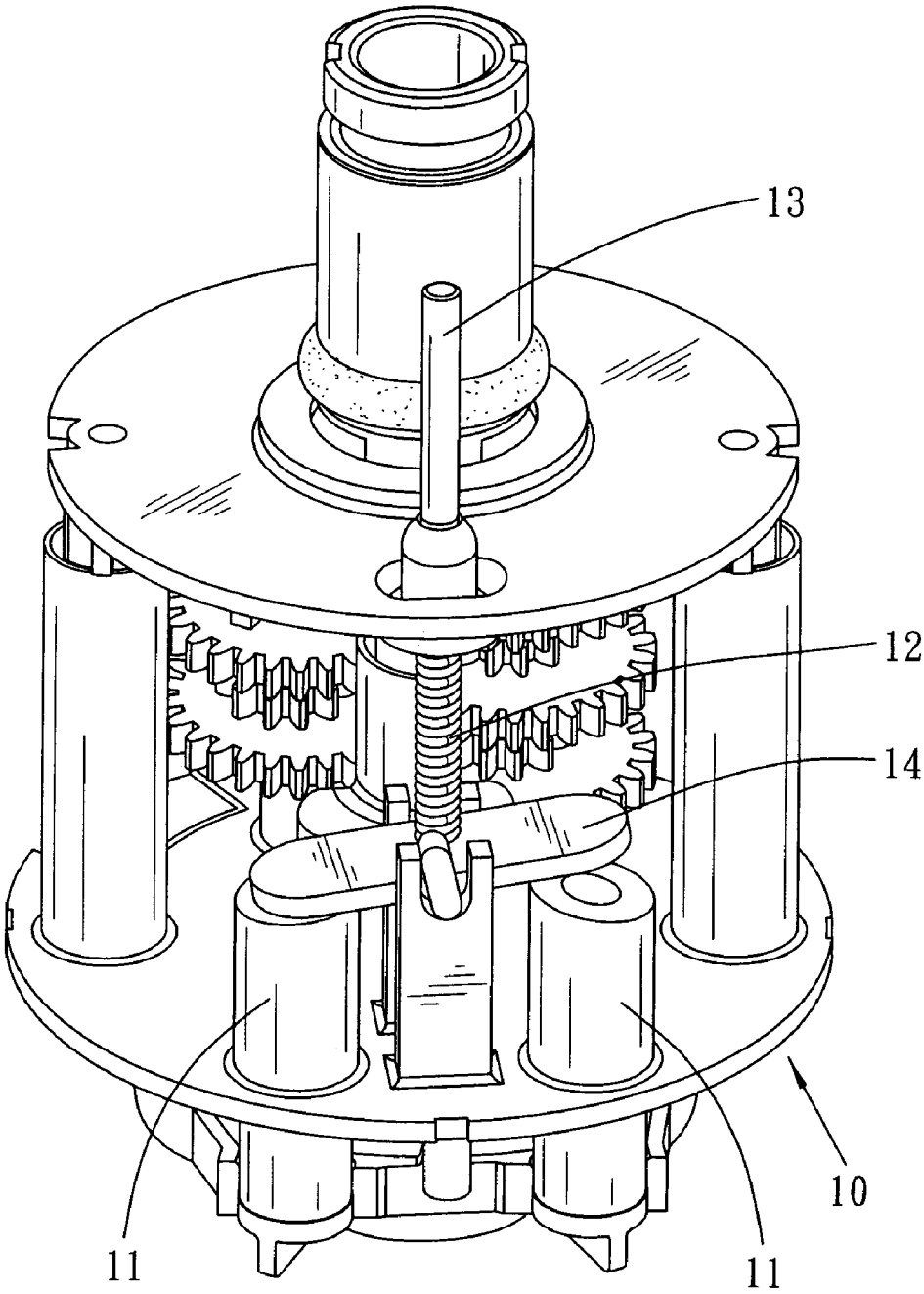
FIG. 1 PRIOR ART
FIG. 1 is a perspective diagram showing the structure of the prior art cited in the European patent application EPO 826427A2.
Figure 2:
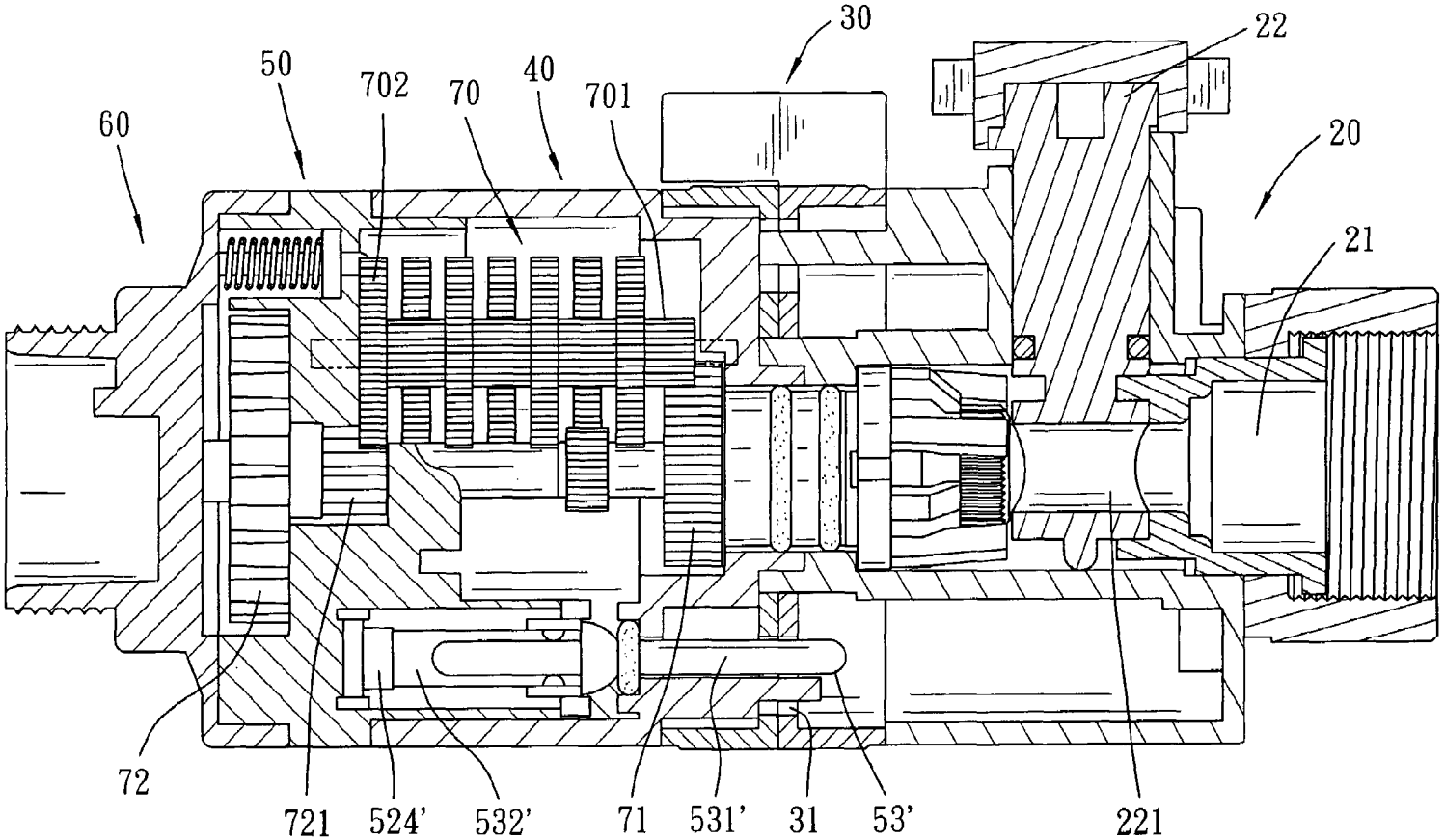
FIG. 2 is a sectional diagram of the present invention.
Figure 6:
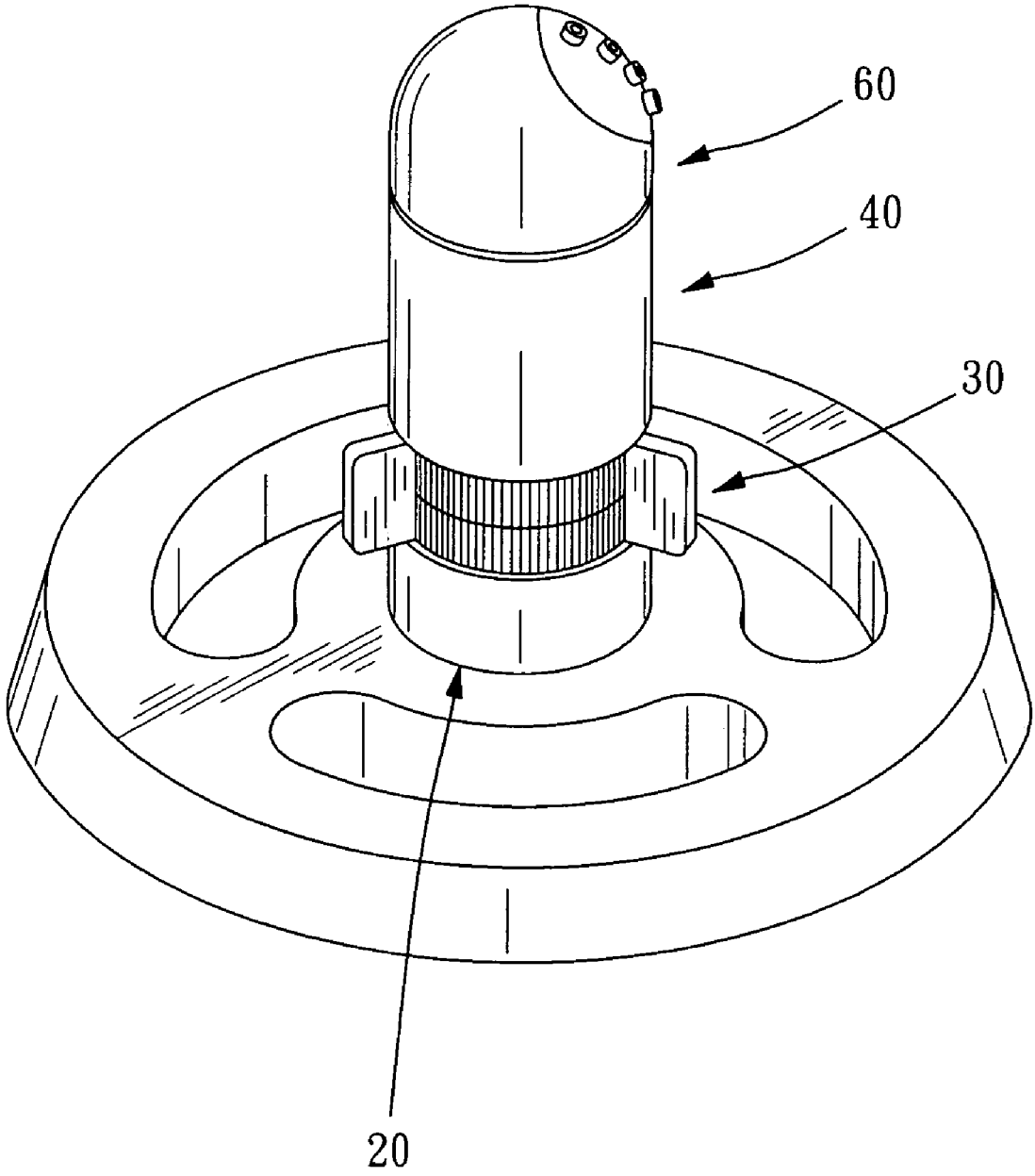
FIG. 6 is a perspective diagram showing the application of the present invention onto a vertical-type oscillating sprinkler.

Referring to FIG. 2, a sectional diagram of the present invention, the oscillating sprinkler, which can be made to position in a horizontal manner or vertical manner as shown in FIG. 6, is comprised of a water inlet connector 20, a restraint connector 30, a moving mount 40, a coupling unit 50, a water outlet connector 60 and a gear set 70.

The water inlet port 21 of the water inlet connector 20 is in communication with the regulating hole 221 of a control valve 22 which can regulate the volume of the incoming water. At one side of the restraint connector 30 is disposed a restraint hole 31 to adjust the maximum angle of the swinging operation of the sprinkler. The coupling unit 50 is placed between the moving mount 40 and the water outlet connector 60.

One side of the gear set 70 is engaged with one side of the coupling unit 50 and is housed in the moving mount 40. The front gear 701 of the gear set 70 is in mesh with a fixed gear 71 and the rear gear 702 is meshed with a driving gear 721 equipped with blades 72. The blades 72 and the driving gear 721 are respectively positioned at the two sides of the center of the coupling unit 50.

Figure 3:
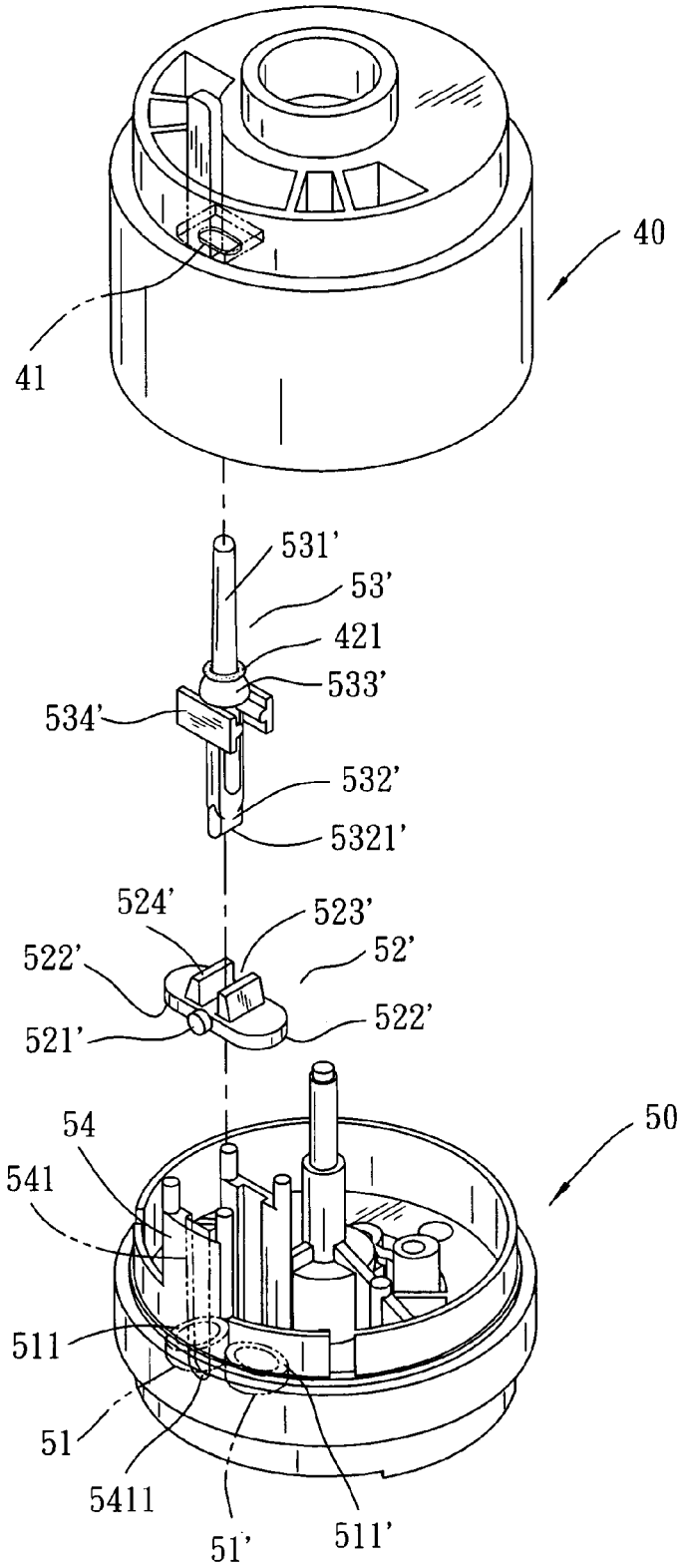
FIG. 3 is a perspective diagram of the disassembly of the first embodiment of the water inlet switching device of the present invention.
Figure 4:
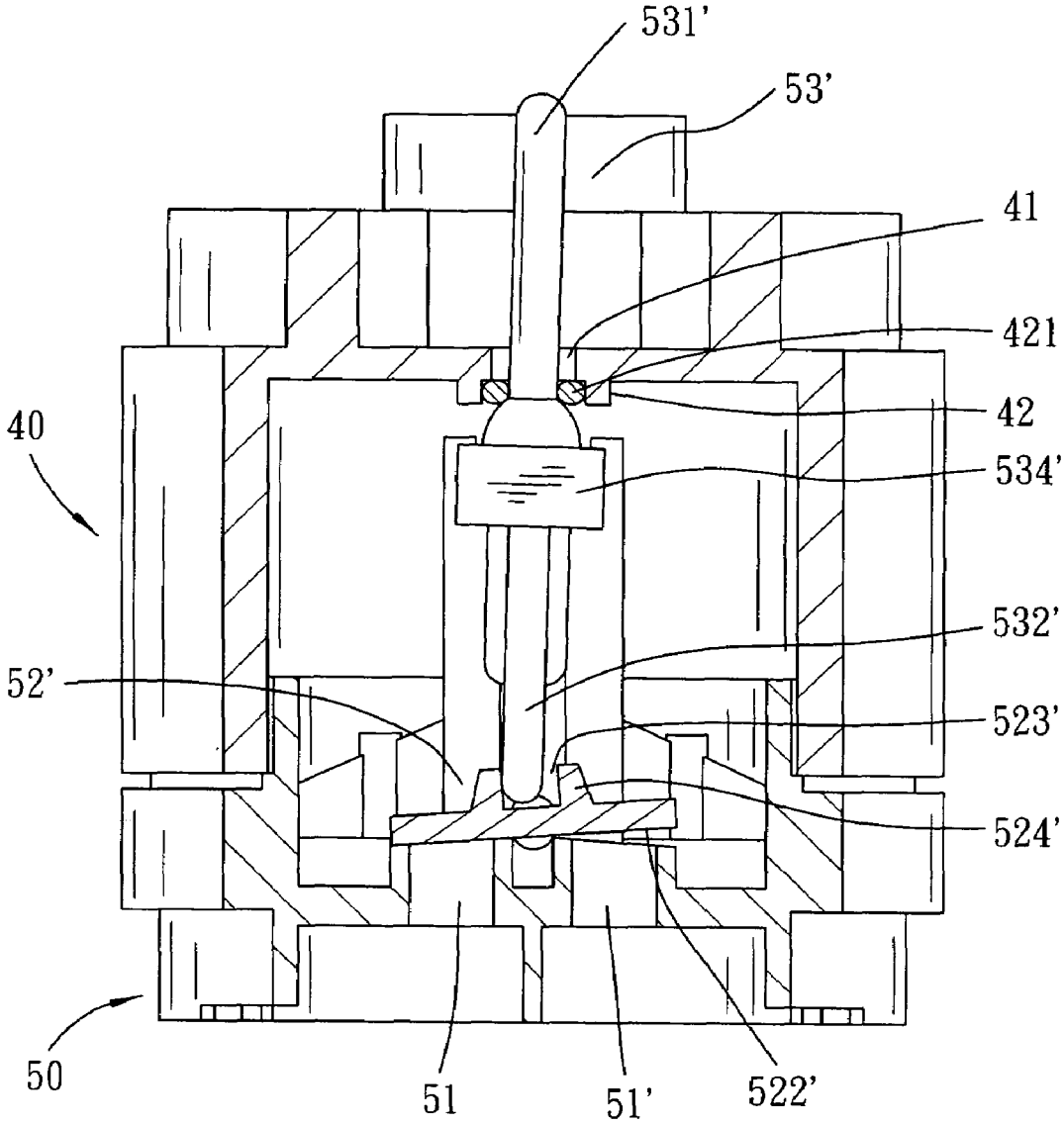
FIG. 4 is a sectional diagram showing the assembly of the water inlet switching device of the present invention.

As shown in FIGS. 3, 4, at the other side of the coupling unit 50 are disposed two neighboring outlet ports 51, 51' each having a slant facet 511, 511' orienting to the left and right respectively; and a water inlet switching device equipped with a movable swing seat 52' and an operation unit 53' operated in cooperation with the coupling unit 50.

Moreover, on each of the opposite sides of the two neighboring outlet ports 51, 51' is disposed a vertical board 54 having a vertically defined restraint groove 541 thereon. The bottom of the restraint groove 541 is terminated in a U-shaped pivot stop 5411 so that the movable swinging seat 52', having an extended rotation protrusion 521' disposed at the center of each side of the bottom thereof, can be guided all the way down along the restraint grooves 541 of the vertical boards 54 and located in place by way of the U-shaped pivot stop 5411 between the two outlet ports 51, 51'. Thus, the movable swinging seat 52' can be pivotal side to side along the rotation protrusions 521'. At each end of the movable swinging seat 52' is disposed a flat water stop end 522' which are selectively engaged with the outlet ports 51, 51' for sealing purpose. At the top of the movable swinging seat 52' is provided with a bounded space 523' having push ends 524' formed at the top thereof.

The operation unit 53' made of plastics consists of an upper drive rod 531' and a lower actuation stick 532' that are integrally made with a taper section 533' disposed therebetween. The actuation stick 532' is designed in the form a flat plate. The upper drive rod 531' is led through a pivot hole 41 of the moving mount 40 and the restraint hole 31 of the restraint connector 30.

At one side of the pivot hole 41 is disposed a ring seat 42 for the fixing of a sealing ring 421 which is in tight abutment against the bulged taper section 533' to affect the sealing. To the bottom of the taper section 531' are attached a pair of vertical reinforced roots 534' in abutment against the top of the vertical boards 54 so as to make the tip end 5321' of the actuation stick 532' extend into flexible engagement with the push ends 524' of the bounded space of the movable swinging seat 52' and further cooperate with the restraint hole 31 of the restraint connector 30. Thus, one of the water stop ends 522' of the movable swinging seat 52' is forced into selective engagement with the oblique facet 511 of the outlet port 51, leaving the other water outlet port 51' in an open state to allow water to flow in to drive the blades 72 and the driving gear 721 to rotate in the direction of the incoming flow. Thereby, the gear set 70, the moving mount 40, the coupling unit 50 and the water outlet connector 60 are made to move in synchronism in the same direction along the fixed gear 71, rendering the sprinkler unit to swing back and forth in response to the direction of rotation of the water outlet connector 60.

Figure 5:
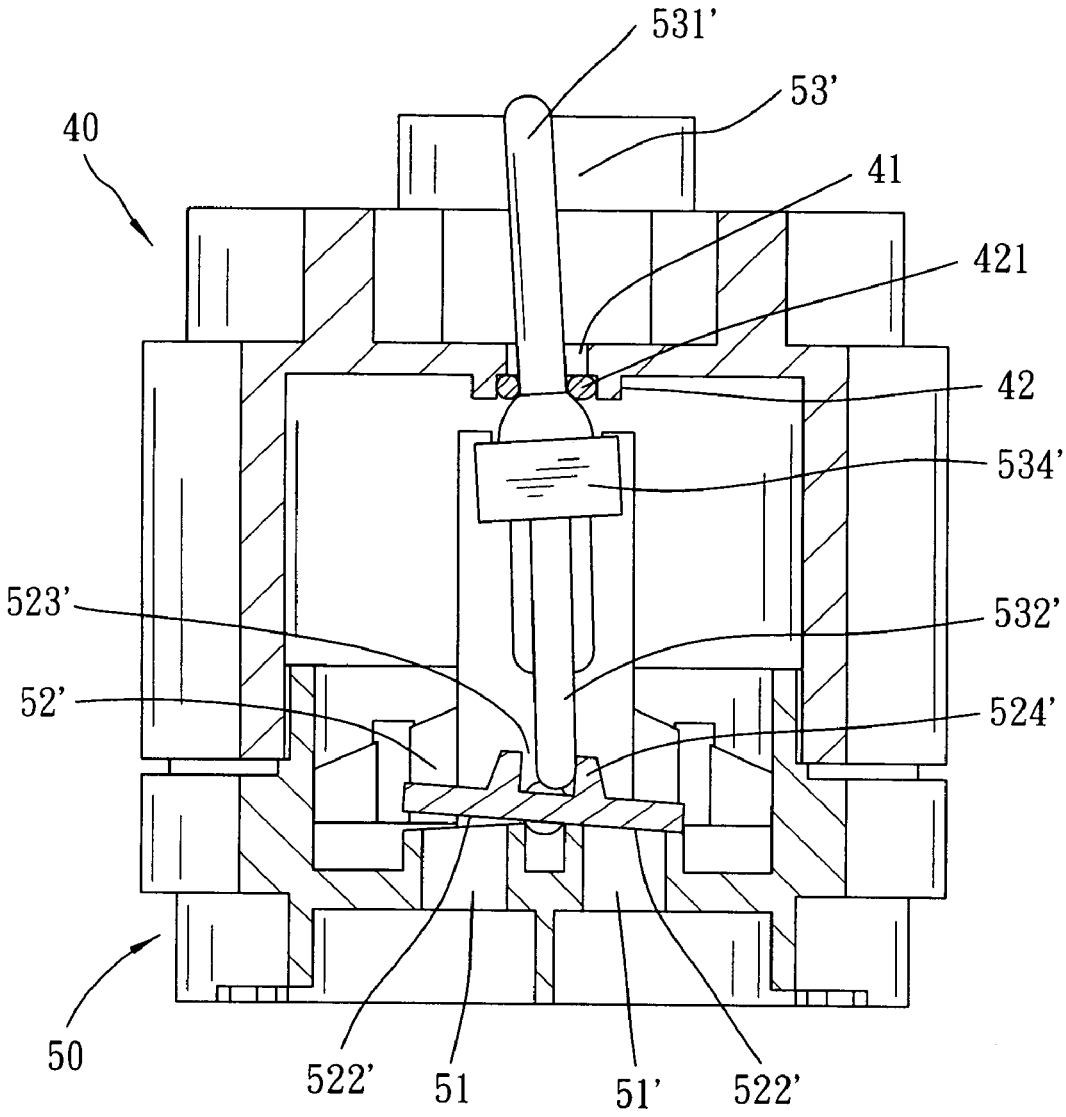
FIG. 5 is a sectional diagram showing the water incoming state of the water inlet switching device of the present invention.

As the sprinkler unit swings to a limiting position as shown in FIG. 5, the drive rod 531' of the operation unit 53' comes into contact against one side of the restraint hole 31 of the restraint connector 30, and the continuous movement of the gear set 70 will make the drive rod 531' limited by the restraint hole 31 drive in linkage the actuation stick 532' to bias in an angle within the bounded space 523' of the movable swinging seat 52' and abut against the push end 524'. Thus, the biased angle of the end 5321' of the actuation stick 532' and the swinging angle of the push ends 524' combine to produce an instantaneous force so as to make the movable swinging seat 52' pivot to the other side, causing the water stop end 522' to come into sealing engagement with the oblique facet 511' of the outlet port 51'. In the meantime, the other water inlet port 51 is accordingly turned into an open state so as to switch the direction of the inflowing water, resulting in the change of the swinging direction of the sprinkling unit. Regardless of the level of the water pressure being high or low, the switching of the direction of the water inflow can be easily carried out as a result of the actuation stick 532' limited in the bounded space 523' producing a relative biased angle with respect to the movable swinging seat 52' to offer an instantaneous push against the push end 524'.

Figure 7:
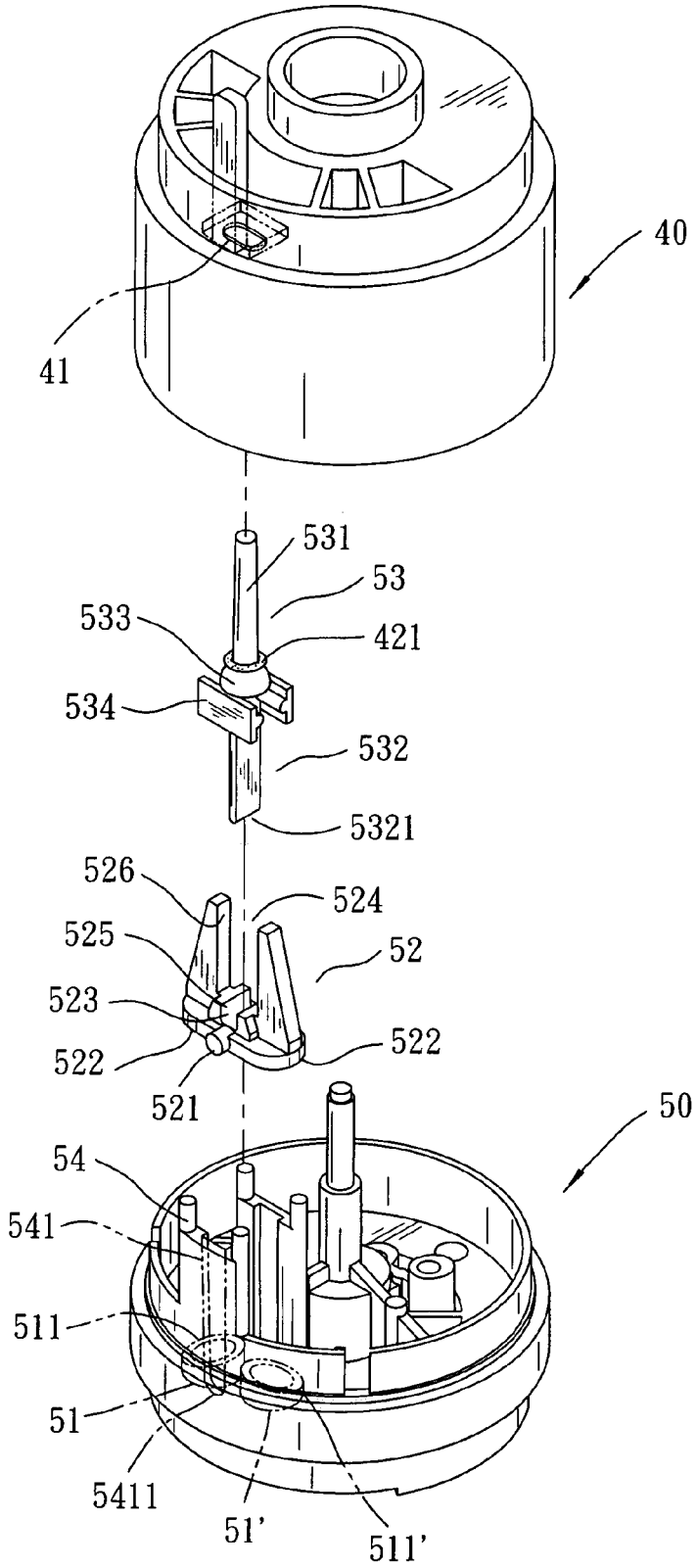
FIG. 7 is a diagram showing the second embodiment of the water inlet switching device of the present invention.
Figure 8:
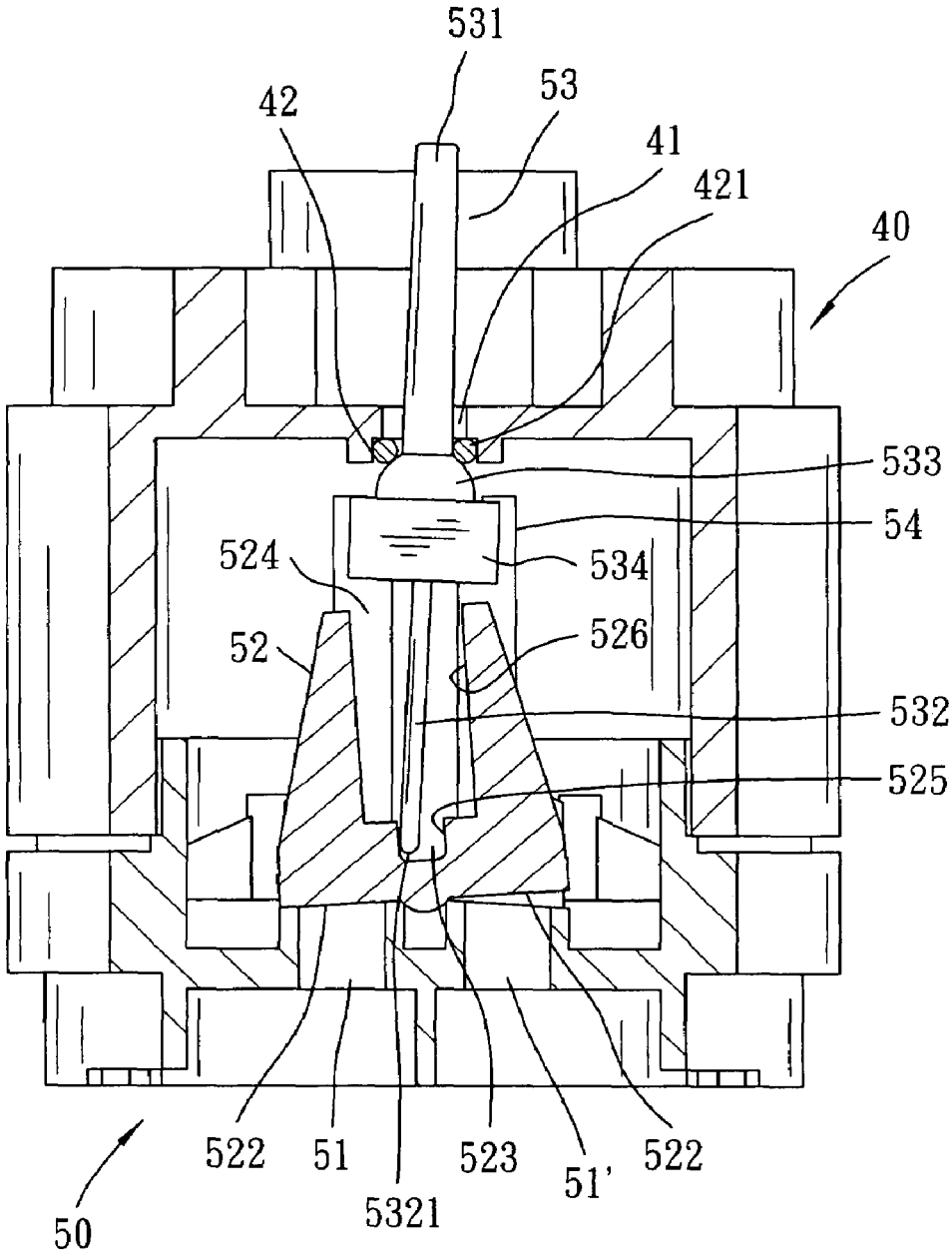
FIG. 8 is a sectional diagram showing the operation mode of the second embodiment of the water inlet switching device of the present invention.

Referring to FIGS. 7, 8, the second embodiment of the present invention, the movable swinging seat 52 is provided with a central rotation protrusion 521 at each side of the bottom thereof that can be guided downwardly along the restraint groove 541 defined between the two vertical boards 54 and abut against the pivot stop 5411 respectively so as to position the movable swinging seat 52 between the two outlet ports 51, 51' of the coupling unit 50. Thus, the rotation protrusions 521 of the movable swinging seat 52 can rotate back and forth between the pivot stops 5411 and the outlet ports 51, 51'. Moreover, there are two flat water stop ends 522 at the bottom of the movable swinging seat 52 in selective registration with the two water outlet ports 51, 51'. There is a narrow bounded space 523 and a wide operation space 524 defined at the top of the movable swinging seat 52 with a low push face 525 and a high push face 526 defined on each of two opposite sides thereof respectively.

The operation unit 53 made of plastics integrally includes a drive rod 531 and an actuation stick 532 which is made in a flat and flexible plate and a bulged taper section 533 is disposed therebetween. The drive rod 531 is led through the pivot hole 41 of the moving mount 40 and the restraint hole 31 of the restraint connector 30. At one side of the pivot hole 41 is disposed a ring seat 42 for the fixing of a sealing ring 421 which is in pressing contact with the taper section 533 to effect sealing purpose. At each side of the bottom of the taper section 533 is attached a reinforcement root 534 that is also engaged with the upper end of each of the two vertical boards 54. Thereby, the actuation stick 532 is housed in the operation space 524 of the movable swinging seat 52 with its end 5321 in pressing abutment against the low push face 525 in the bounded space 523 and further in cooperation with the restraint hole 31 of the restraint connector 30 to urge one of the water stop end 522 of the movable swinging seat 52 into sealing engagement with the oblique facet 511 of the water outlet port 51. At the same time, the other outlet port 51' is left open to allow water to flow in to drive the blades 72 and the driving gear 721 to move in the direction of the inflow water and offer hydraulic power to the gear set 70, the moving mount 40, the coupling unit 50 and the water outlet connector 60 to move in synchronism all together with respect to the fixed gear 71, allowing the sprinkler unit to swing back and forth in line with the movement of the water outlet connector 60.

Figure 9:
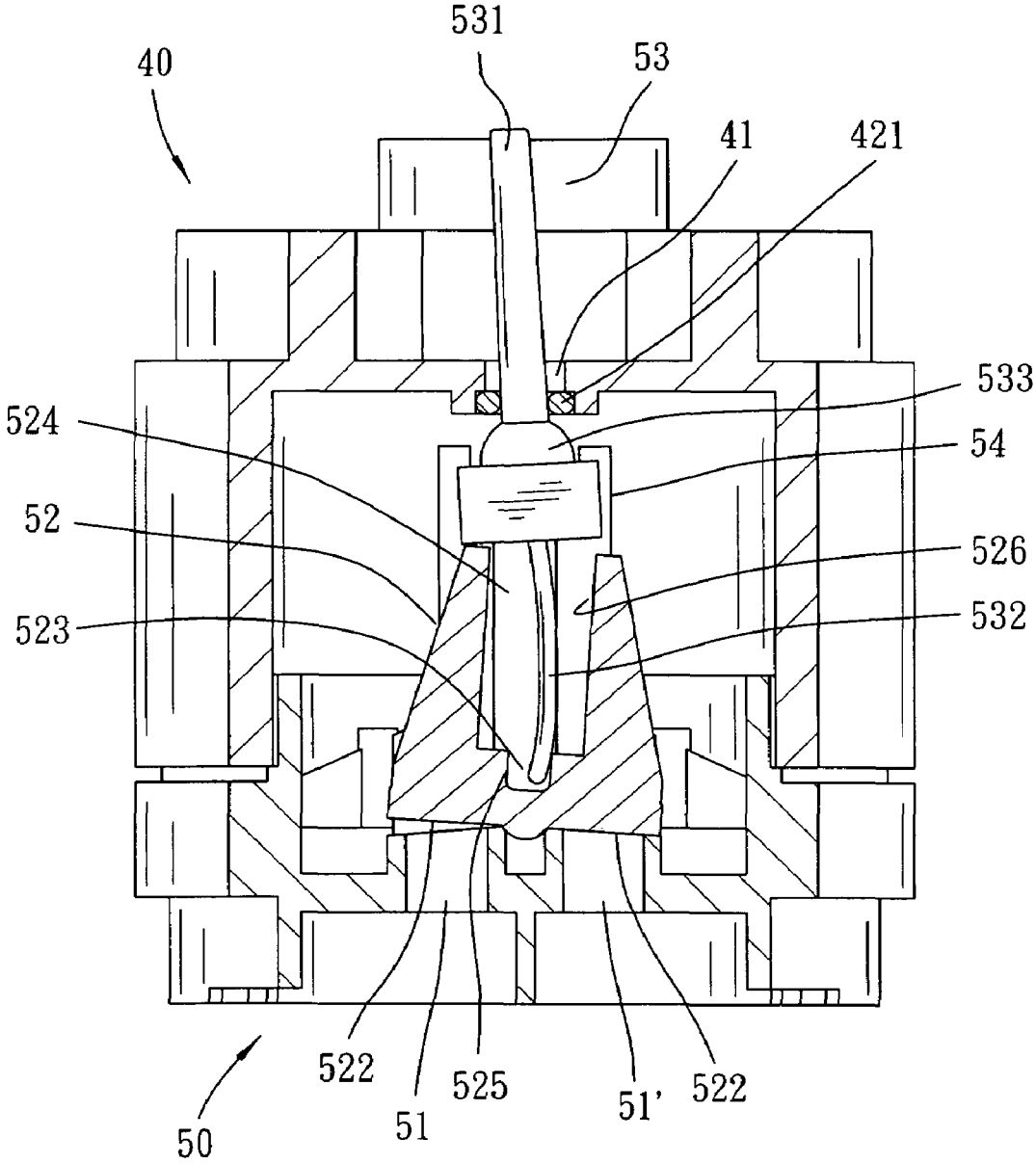
FIG. 9 is a diagram showing the operation of the water inlet switching device of FIG. 8 with the actuation stick confined in a bounded space to gradually build up energy of torsion and pushing against the high and low push faces.
Figure 10:
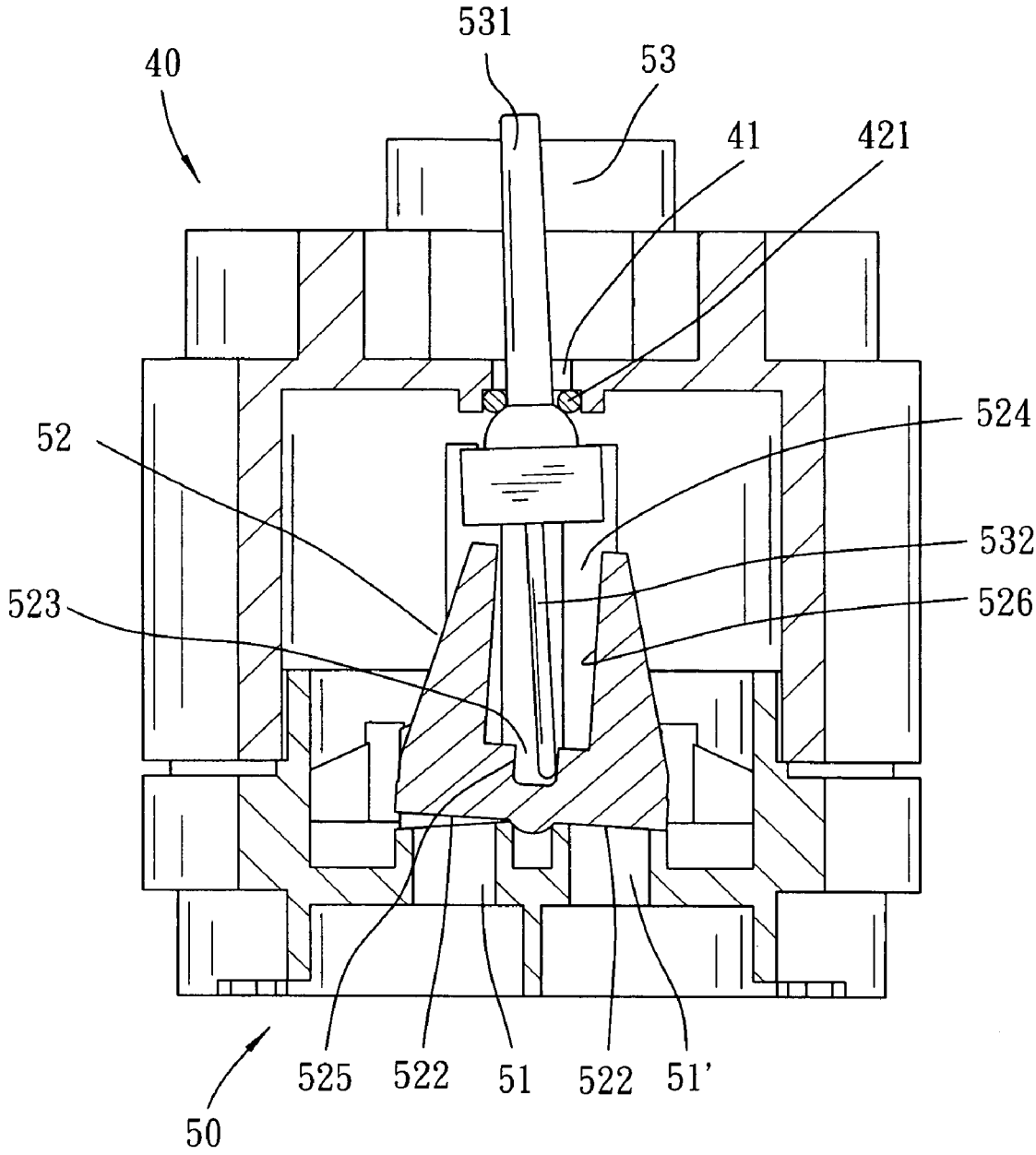
FIG. 10 is a diagram showing the water inlet switching device of FIG. 9 having completed the water switching operation.

Referring to FIGS. 9, 10, as the sprinkler unit swings to a limiting position, the drive rod 531 of the operation unit 53 comes into contact against one side of the restraint hole 31 of the restraint connector 30, and the continuous movement of the gear set 70 will make the drive rod 531 limited by the restraint hole 31 to bend to one side and drive in linkage the actuation stick 532 to flexibly bend within the operation space 524 of the movable swinging seat 52. Accordingly, the end 5321 builds up spring energy due to the bending in the bounded space 523 to generate a force in abutment against the low push face 525 so as to permit the end 5321 to instantaneously push the movable swinging seat 52 to pivot to the other side, making the water stop end 522 engage with the oblique facet 511' of the water outlet port 51'. Right after that operation, the actuation stick 532 bounces back to resume its natural status with its elastic force concentrated at the bottom end and applying to the low push face 525 so as to ensure the sealing of water outlet port 51' and the opening of the other water outlet port 51. This operation permits the switching of the direction of water inflow and varying the swinging direction of the sprinkler unit.

Moreover, under a high water pressure, the actuation stick 532 will be bent in a proper curvature to store up energy in the operation space 524 and contact with the low push face 525 and the high push face 526, making the elastic bending force of the actuation stick 532 larger than the high water pressure applied to the water outlet port 51' and ensuring the instantaneous switching of the direction of water inflow. Thus, regardless of the level of water pressure being high or low, the linkage operation of the operation unit 53 and the actuation stick 532 operating in the operation space 524 and the bounded space 523 can store up energy and with the help of the high and low push face 526, 525, the movable swinging seat 25 can be surely switched to vary the direction of water inflow.

Figure 11:
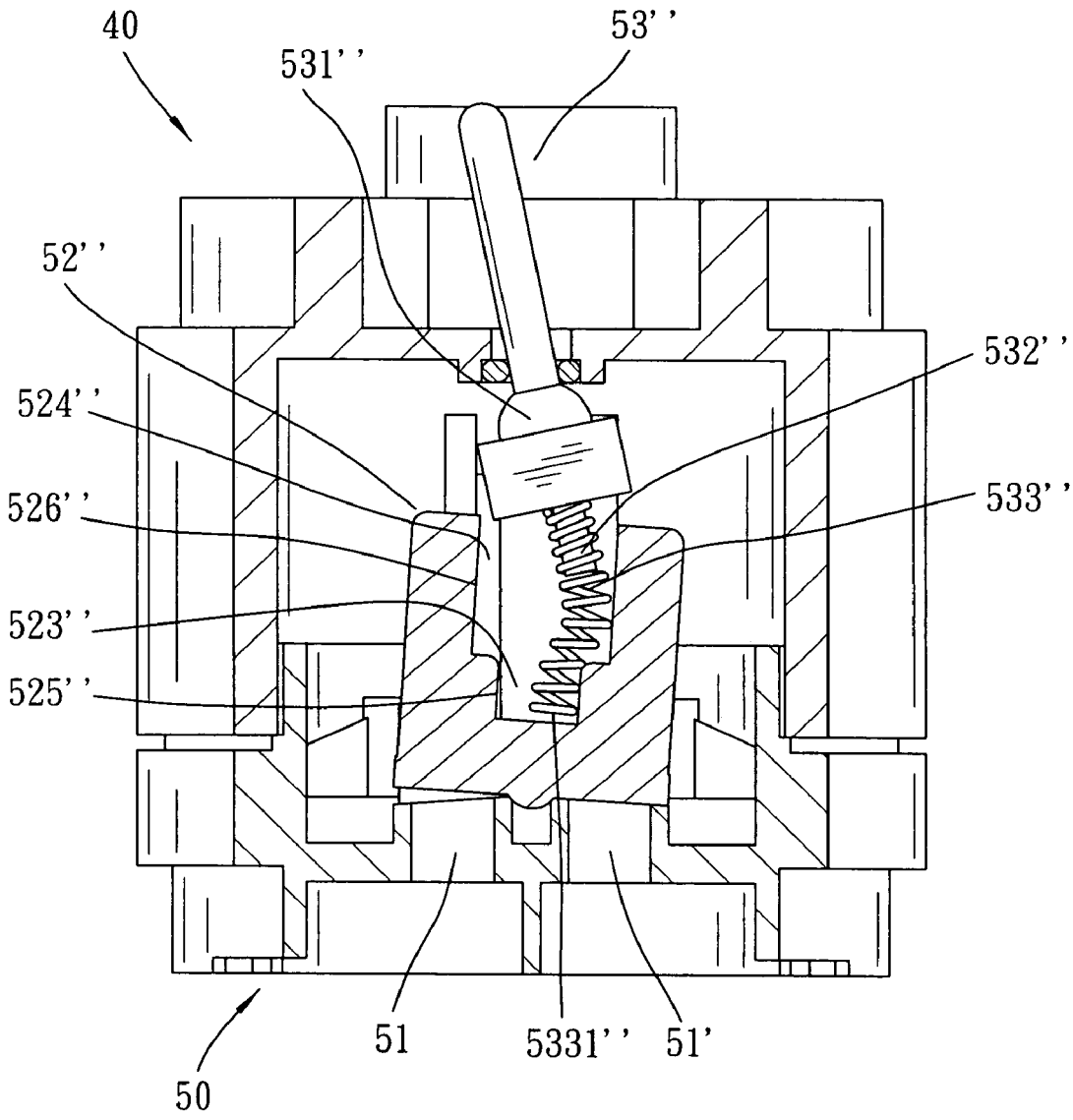
FIG. 11 is a diagram showing the third embodiment of the water inlet switching device of the present invention and demonstrating the operation of the water inlet switching device with the actuation stick confined in a bounded space to gradually build up energy of torsion and pushing against the high and low push faces.
Figure 12:
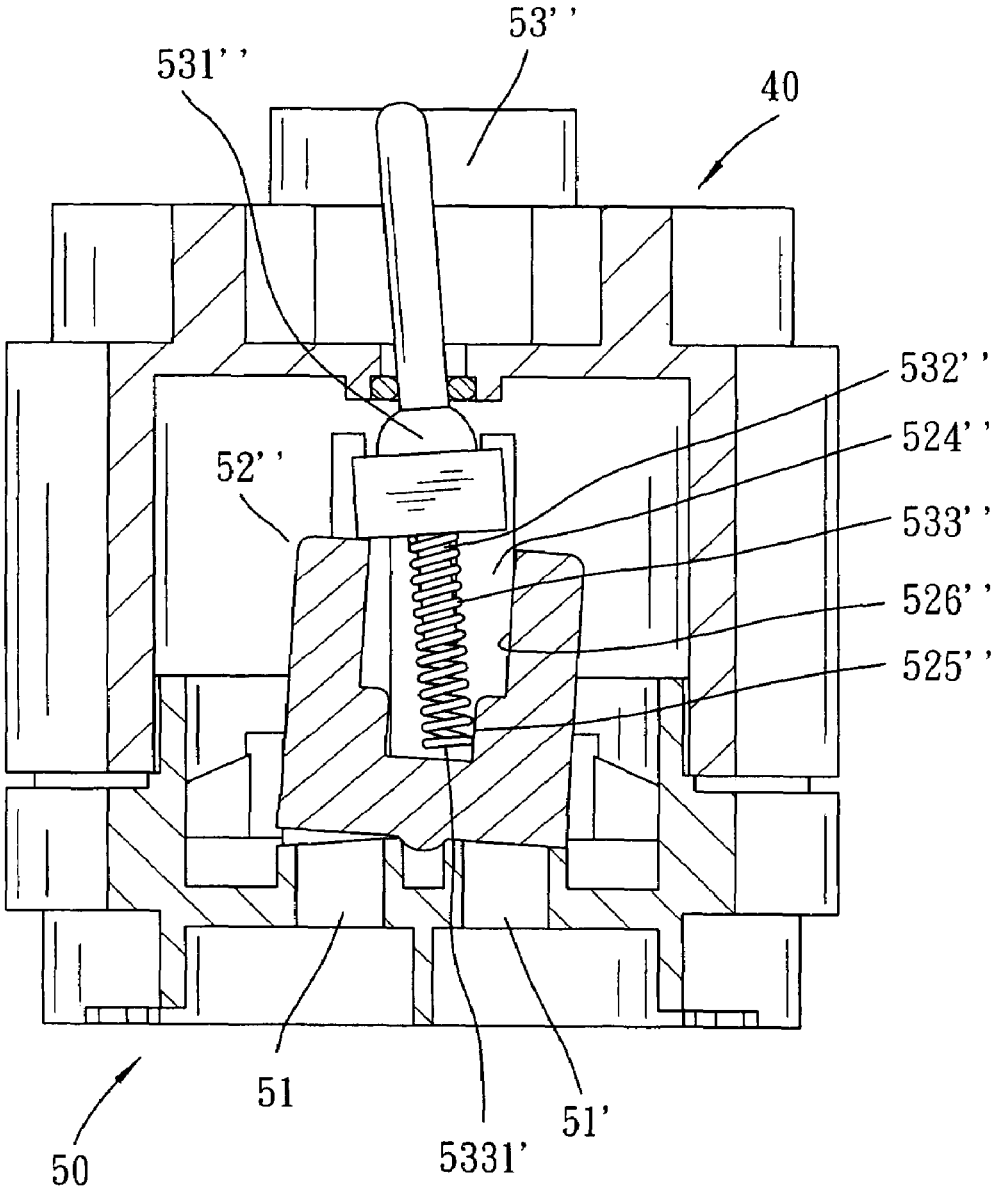
FIG. 12 is a diagram showing the water inlet switching device of FIG. 11 having completed the water switching operation.

As shown in FIGS. 11 and 12, the third embodiment of the present invention is illustrated. The operation unit 53" is equipped with at the bottom of the taper 531" an extended engagement post 532" for the mounting of a spring type actuation device 533" which is placed inside the operation space 524" and the bounded space 523" of the movable swinging seat 52". The end of the spring actuation device 533" is in abutment against one of the low push faces 525" of the bounded space 523" so as to make the water outlet port 51" sealed, permitting water to flow out via the other water outlet port 51. Moreover, by way of the curvature of the flexibly bent spring actuation device 533" and the help of the high and low push faces 526", 525" in the operation space 524" and the bounded space 523", their mutual abutments and interactions allow the spring actuation device 533" to store up bending energy without dispersion so that the sprinkler can be operated normally regardless of the level of the water pressure. After the movable swinging seat 52" is switched to a new position, the spring actuation device 533" resumes its original status and that will help keep its flexibility in normal and its operation life longer. Besides, the elastic force of the resumed spring actuation device 533" can be concentrated at the bottom end 5331", good enough to abut against the low push face 525" to ensure the water outlet port 51' is firmly sealed and in the best operation status.

Figure 13:
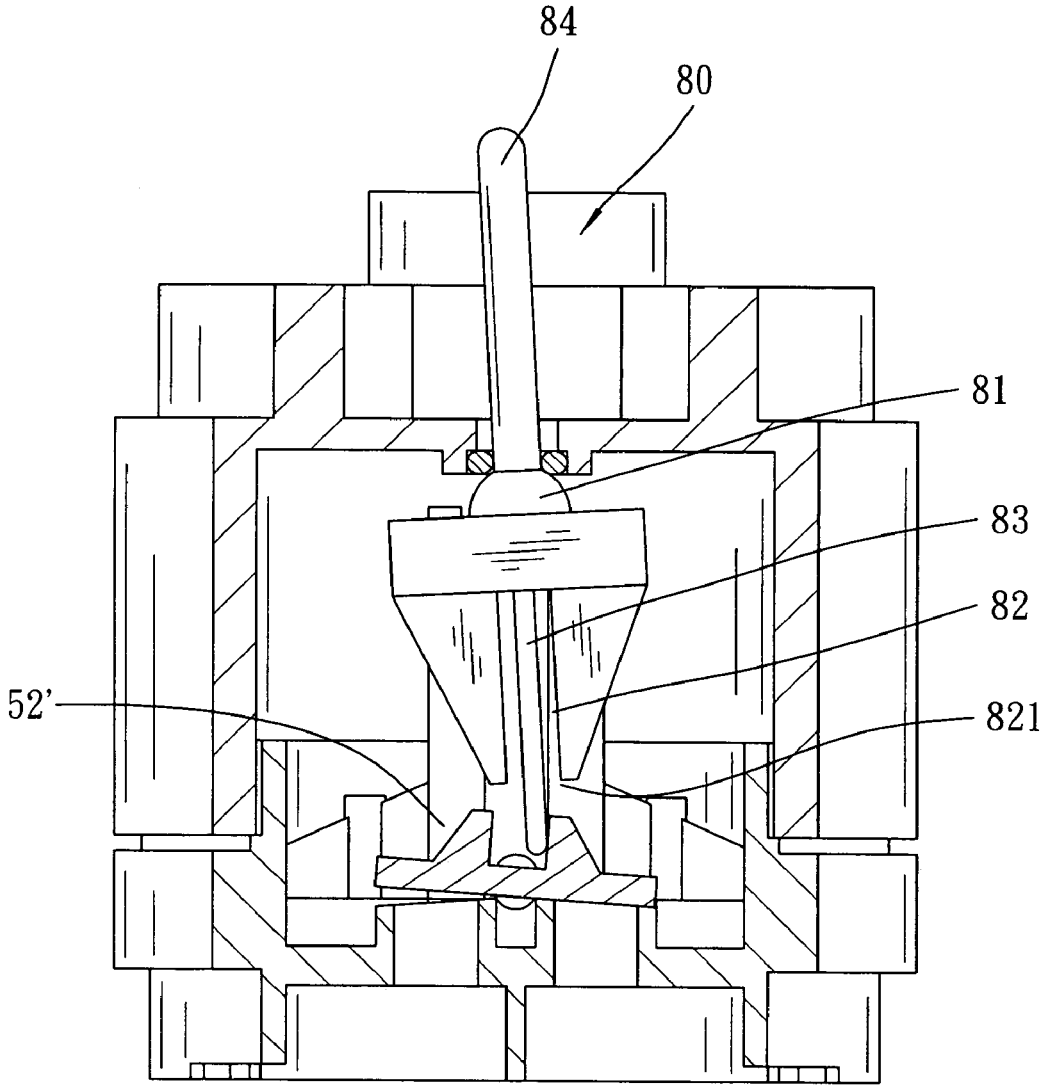
FIG. 13 is a diagram showing the fourth embodiment of the present invention.

Referring to FIG. 13, in the fourth embodiment of the present invention, the operation unit 80 of the water inlet switching device is equipped with a downwardly extended long vertical slot 82 under the bottom of the taper section 81 with the actuation stick 83 just extending at the center of the slot 82 and into the bounded space 523' of the movable swinging seat 52'. Thereby the drive rod 84 of the operation unit 80 can be operated in linkage to switch the movable swinging seat 52' for varying the direction of inflow water. Besides, when the water pressure is at high level, the actuation stick is flexibly bent to accumulate energy and one bottom tip end 821 of the vertical slot 82 will come into abutment against the bent actuation stick 83 and produce an auxiliary force to push the movable swinging force 52' to switch the direction of the inflow water regardless of the level of the water pressure.

Figure 14:
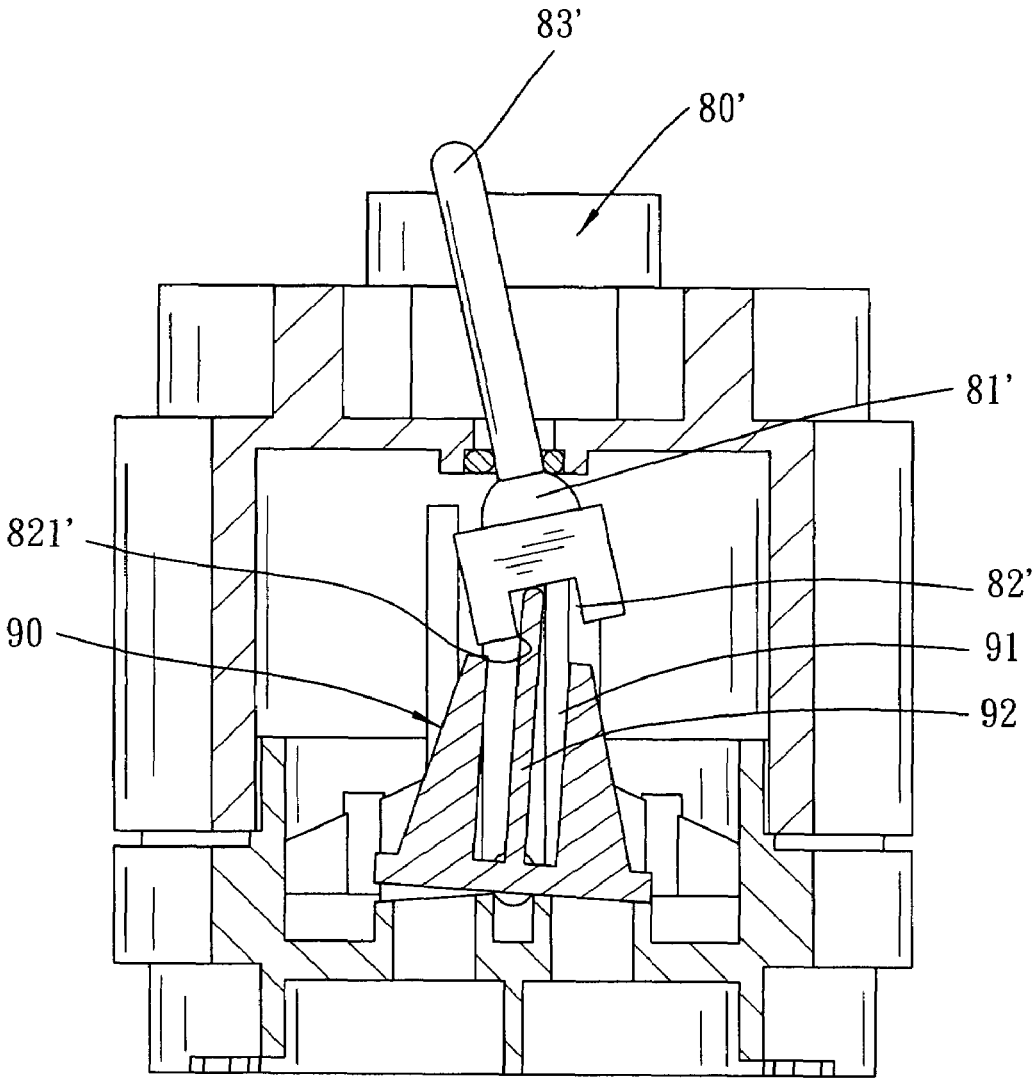
FIG. 14 is a diagram showing the fifth embodiment of the present invention.

As shown further in FIG. 14, in the fifth embodiment of the present invention, the operation unit 80' is provided with a short vertical slot 82' at the bottom of the taper section 81'; and at the top of the movable swinging seat 90 is disposed a bounded space 91 with a long actuation stick 92 extends into and abuts against the slot 82' so that as the drive rod 83' is pushed to one side, one corner 821' of the slot 82' will forcedly urge the actuation stick 92 and the movable swinging seat 90 to pivot in an opposite direction of the drive rod 83' for switching the direction of inflow water accordingly.

What is claimed is:

1. An automatic water inlet switching device for an oscillating sprinkler comprising a sprinkle control unit which drives a sprinkle means to produce angular swinging movement; said sprinkle control unit having a blade-equipped gear transmission set housed therein and working together with a water inlet switching device having an operation unit and a movable swinging seat; said movable swinging seat being provided with two water stop ends at the bottom thereof, in opposite to two water outlet ports defined on a coupling unit and one of said water outlet ports being selectively blocked by one of said water stop ends in operation; and a concaved bounded space having push faces defined therein and placed at the center of the top of said movable swinging seat to operate in cooperation with an actuation stick of the operation unit which comprises an drive rod in connection to said actuation stick operable inside said bounded space so as to move in linkage with said actuation stick; whereby as said sprinkle unit swings to a limiting position set up by a restraint connector in the water inlet switching operation the swinging angle of said actuation stick is limited within said bounded space and said actuation stick will move against said push face of said bounded space so as to gradually produce a built-up force to instantaneously spring away said movable swinging seat whether the water pressure is in high or low operation.

2. The automatic water inlet switching device for an oscillating sprinkler as claimed in claim 1 wherein said coupling unit is equipped with a pair of vertical boards each having a restraint groove with a pivot stop defined at a U-shaped bottom end of each said restrain groove; said two water outlet ports being disposed between said two vertical boards and said movable swinging seat being provided with a pivot protrusion on each side so as to permit said pivot protrusion to be guided along said restraint grooves on said vertical boards and pivotally held in place by said pivot stops whereby said movable swinging seat can be swung back and forth to selectively block one of said water outlet ports accordingly.

3. The automatic water inlet switching device for an oscillating sprinkler as claimed in claim 1 wherein said operation unit is made of plastics.

4. The automatic water inlet switching device for an oscillating sprinkler as claimed in claim 1 wherein said operation unit is equipped with a taper section at the middle thereof whereby a sealing ring can be led through said operation unit and is in urging contact against said taper section for sealing purpose.

5. The automatic water inlet switching device for an oscillating sprinkler as claimed in claim 4 wherein said taper section is provided with a reinforcement root at each of two parallel sides at the bottom thereof.

6. The automatic water inlet switching device for an oscillating sprinkler as claimed in claim 1 wherein said movable swinging seat is provided with a narrow bounded space and a wide operation space defined at the top of said movable swinging seat with a low push face and a high push face on each two opposite sides thereof respectively; said actuation stick is of a flat flexible plate and is integrally formed with said operation unit and said actuation stick placed in said operation space of said movable swinging seat with its tip end in urging contact with one of said low push faces and working with said restraint connector to pivot one of said water stop ends of said movable swinging seat to seal one of said water outlet ports and to keep the other water outlet port in an open state.

7. The automatic water inlet switching device for an oscillating sprinkler as claimed in claim 1 wherein said operation unit is equipped with a spring engagement post at the bottom of said drive rod for the mounting of a spring means which serves as an actuation stick means.

8. The automatic water inlet switching device for an oscillating sprinkler as claimed in claim 7 wherein a taper section is defined between said drive rod and said spring engagement post with a sealing ring in sealing engagement with said taper section for sealing purpose.

9. The automatic water inlet switching device for an oscillating sprinkler as claimed in claim 1 wherein said operation unit is equipped with a vertical slot opening with said actuation stick positioned at the center of said slot opening and an end of said actuation stick in contact engagement with said bounded space of said movable swinging seat.

10. The automatic water inlet switching device for an oscillating sprinkler as claimed in claim 1 wherein said operation unit is equipped with a vertical slot opening and said actuation stick extends from said bounded space of said movable swinging seat and is in contact engagement with said vertical slot opening of said operation unit.

* * * * *